United States Patent [19]

Miyazaki et al.

[11] Patent Number: 4,815,529

[45] Date of Patent: Mar. 28, 1989

[54] HEAT PIPE

[75] Inventors: Yoshio Miyazaki, Fuchu; Yuji Ido, Yokohama, both of Japan

[73] Assignee: Kabushiki Kaisha Toshiba, Kawasaki, Japan

[21] Appl. No.: 193,190

[22] Filed: May 13, 1988

Related U.S. Application Data

[63] Continuation of Ser. No. 813,984, Dec. 27, 1985, abandoned.

[30] Foreign Application Priority Data

Dec. 27, 1984 [JP] Japan ..... 59-273930
Sep. 30, 1985 [JP] Japan ..... 60-215139

[51] Int. Cl.[4] ..... F28D 15/02
[52] U.S. Cl. ..... 165/104.26; 122/366
[58] Field of Search ..... 165/104.26; 122/366

[56] References Cited

U.S. PATENT DOCUMENTS 3,305,005 2/1967 Grover et al. ..... 165/104.26
3,537,514 11/1970 Levedahl ..... 165/104.26
3,675,711 7/1972 Bilinski et al. ..... 165/104.26

FOREIGN PATENT DOCUMENTS 0186216 7/1986 European Pat. Off. .
2104183 8/1974 Fed. Rep. of Germany .
55-41361 3/1980 Japan .
718689 2/1980 U.S.S.R. ..... 165/104.26

OTHER PUBLICATIONS

Rankin et al, "Thermal Management System Technology Development for Space Station Applications", *SAE Technical Paper Series,* Jul. 11-13, 1983.
R. Ponnappan et al, "Development of a Double-Wall Artery High Capacity Heat Pipe," AIAA/ASME 3rd Joint Thermophysica, Fluids, Plasma & Heat Transfer Conference (AIAA 82 0906), Jun. 7-11, 1982.
Von O. Brost et al, "Waermerphre-Auslegung, Betrieb, Anwendungsbeispiele, 263 Waerme", vol. 86, Aug. 1980, pp. 71-74.
J. D. Parker, "Heat Pipes Gain Use in Heat Transfer", *Oil and Gas Journal,* vol. 75, No. 37 (1977).

*Primary Examiner*—Albert W. Davis, Jr.
*Attorney, Agent, or Firm*—Foley & Lardner, Schwartz, Jeffery, Schwaab, Mack, Blumenthal & Evans

[57] ABSTRACT

A heat pipe in accordance with the present invention includes an outer pipe and an inner pipe which is inserted to the outer pipe, coolant return routes with relatively large cross-sectional area are provided on the inner side of the outer pipe from the evaporation section to the condensation section, grooves with relatively small cross-sectional area are provided on the inner surface of the inner pipe from the evaporation section to the condensation section, and connective openings are provided on the inner pipe for connecting through the grooves to the coolant return routes.

4 Claims, 5 Drawing Sheets

HEAT PIPE

This application is a continuation of application Ser. No. 813,984 filed Dec. 27, 1985 now abandoned.

BACKGROUND OF THE INVENTION

1. Field of the Invention

The present invention relates to a heat pipe for carrying out heat transfer by circulating a coolant between the evaporation section and the condensation section, in particular, to a heat pipe which is capable of improving the heat transfer capacity.

2. Description of the Prior Art

In order to enhance the heat transfer capability of a heat pipe which transfers heat between the condensation section and the evaporation section, there is currently available a heat pipe that is equipped with arteries, namely, special return route for the condensed fluid from the condensation section to the evaporation section.

As examples of this type of heat pipes one may mention those shown in FIG. 1 and FIG. 2. In FIG. 1 is shown a type of heat pipe in which a mesh 12 to work as a wick is installed on the inner surface of a piping 10, and a portion of the mesh 12 is deformed to form a return route 14 for the condensed fluid. Further, in FIG. 2 is shown another type in which grooves 18 are provided in the circumferential direction on the inner surface of the piping 16, as well as a felt-like metal 20 that forms the return route for the condensed fluid is inserted in the interior of the piping 16.

However, in the prior examples shown in FIGS. 1 and 2, there exist problems concerning mechanical strength on the heat pipe such as deformation or displacement of the mesh 12 (FIG. 1) or the felt-like metal 20 (FIG. 2) in the pipe interior, caused by vibrations of some kind or other. In addition, it is extremely difficult to produce these insertions in such a way as to let them adhere closely to the inner surface of the piping 10 and 16 (FIGS. 1 and 2). Furthermore, in the case of the type shown in FIG. 1, there exists a possibility of generating a fluid film between the mesh 12 and the inner wall of the piping 10, which leads to a problem of increasing the heat resistance.

In contrast, there is a type called monogroup heat pipe, as shown in FIG. 3, in which there is provided in the container 22 a return route 28 for condensed fluid separately from the vapor passage 26 that has grooves 24 in the circumferential direction.

The type shown in FIG. 3, although the above problems can be avoided due to the fact that there exists no insertion in the pipe interior, leads to problems that the heat pipe becomes large in size and heavy in weight because of the arrangement that the vapor passage 26 and the return route 28 for condensed fluid have to be provided separately. Moreover, it has to deal with a difficult mechanical manufacturing problem, which applies also to the example shown in FIG. 2, of providing grooves 24 in the circumferential direction (in FIG. 2, it is the grooves 18 in the circumferential direction).

SUMMARY OF THE INVENTION

An object of the present invention is to provide a heat pipe which is capable of improving the heat transfer capacity.

Another object of the present invention is to provide a heat pipe which is capable of improving the mechanical strength of the pipe without making it large in size.

Still another object of the present invention is to provide a heat pipe which is easy to manufacture without requiring grooves in the circumferential direction on the inner surface of the pipe.

In a heat pipe that includes an outer pipe and an inner pipe that is inserted to the outer pipe, a feature of the present invention is to provide coolant return paths with relatively large cross-sectional area between the inner and the outer pipes, extending from the evaporation section to the condensation section, to provide grooves with relatively small cross-sectional area on the inner surface of the inner pipe, as well as to provide connective openings on the inner pipe for connecting through the grooves to the coolant return paths.

Another feature of the present invention in a heat pipe that includes an outer pipe and an inner pipe that is inserted to the outer pipe, is to provide the inner pipe with a double-pipe structure that consist of an inside pipe that forms a coolant return route and an outside pipe that forms a vapor passage. Grooves with relatively small cross-sectional area are provided on the inner surface of the outside pipe, extending from the evaporation section to the condensation section. Connective openings that are connected through to the grooves are provided on the outer ircomferential surface of the inner pipe, and a connecting route for connecting through the inside pipe to the connective openings is provided on the outside pipe, between the inside pipe and the outside pipe.

These and other objects, features and advantages of the present invention will be more apparent from the following description of the preferred embodiments taken in conjunction with the accompanying drawings.

DESCRIPTION OF THE PREFERRED EMBODIMENTS

Figure 1:
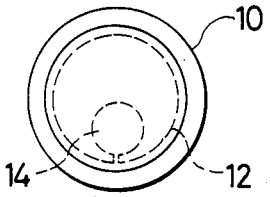
FIG. 1 PRIOR ART
FIGS. 1 and 2 are cross-sectional views for prior heat pipes of artery type.
Figure 2:
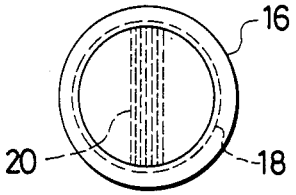
FIG. 2 PRIOR ART
Figure 3:
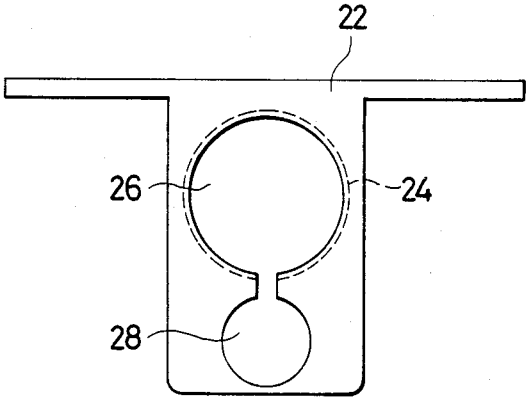
FIG. 3 PRIOR ART
FIG. 3 is a cross-sectional view for a prior heat pipe of monogroup type.
Figure 4:
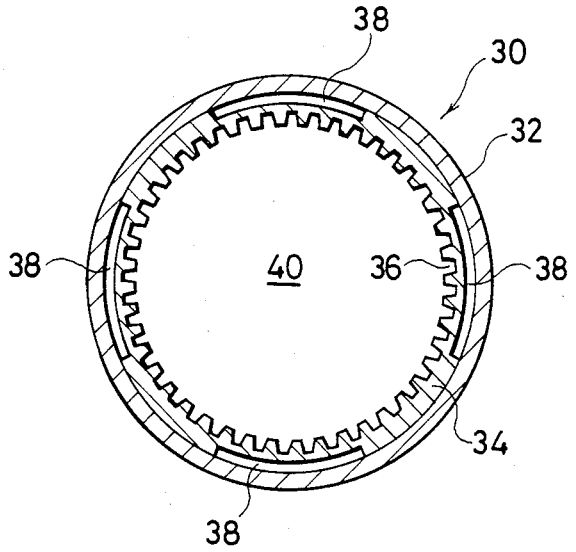
FIG. 4 is a cross-sectional view for a heat pipe embodying the present invention.
Figure 5:
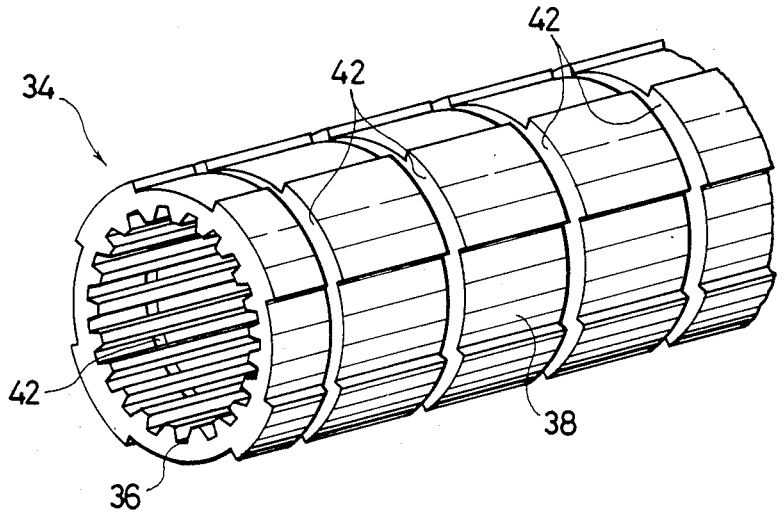
FIG. 5 is a perspective view for the inner pipe of the heat pipe shown in FIG. 4.

Referring to FIGS. 4 and 5, a heat pipe embodying the present invention is shown with reference numeral 30. The heat pipe 30 includes a hermetically sealed outer pipe 32 and an inner pipe 34 which is inserted closely adhering to the inner surface of the outer pipe 32.

On the inner surface of the inner pipe 34 there are provided a plurality of grooves 36, arranged along the direction of the pipe axis, that extend on the entire circumference of the pipe. In addition, on the outer surface of the inner pipe 34 there are provided a plurality of coolant return routes 38 that are formed along the pipe axis. Furthermore, each of the grooves 36 are formed to have a smaller cross-sectional area than the cross-sectional area of each of the coolant return routes 38. Moreover, in the interior of the inner pipe 34 there is formed a vapor passage 40 for the coolant that is evaporated in the evaporation section. The groove 36 has a function of generating a pressure difference by means of capilary force for flowing the liquid coolant from the condensation section to the evaporation section, as well as a function of generating heat transfer during condensation process and the evaporation process. For these purposes, the grooves 36 are made narrow and are arranged to contact the vapor phase with larger area. The coolant return routes 38 are what are called arteries that are provided between the outer pipe 32 and the inner pipe 34, and serve as major routes for the liquid coolant that is condensed in the condensation section for returning to the evaporation section. For this reason, the cross-sectional area of the coolant return routes 38 is made relatively large in order to reduce the flow resistance of the liquid coolant on return.

Furthermore, there are drilled a plurality of slits 42 in the circumferential direction of the inner pipe 34 to serve as connective paths for connecting through the grooves 36 and the coolant return routes 38. These slits 42 are formed on the outer circumferential side of the inner pipe 34 extending over the entire circumference, and are connected through to the grooves 36 on the inner circumferential side.

After evacuating the interior of the heat pipe thus constructed, an appropriate kind of coolant is sealed in it. The amount of the coolant to be sealed may be sufficient if it fills the grooves 36 of the inner pipe 34 and the coolant return routes 38.

The coolant that is evaporated in the evaporation section reaches the condensation section through the evaporation passage 40, and the liquid coolant that is condensed there is circulated back to the evaporation section through the coolant return routes 38. With this arrangement, then, it becomes possible to obtain a large flow even with a slight capillary force so that the dry-out in the evaporation section can be suppressed and large heat transfer capability can be obtained.

Furthermore, there are portions in which the outer pipe 32 and the inner pipe 34 come into direct contact, so that it is possible to transfer heat efficiently through the outer pipe 34 to the evaporating surface and the condensing surface on the side of the inner pipe 34. Due to this, there will not be generated a large heat resistance in the evaporation section and the condensation section, as it is generated in the case for the artery type heat pipe that uses a mesh.

Moreover, the grooves 36 on the inner pipe 34 may be formed by extrusion and the slits 42 may be worked up from its outer surface so that the manufacture can be achieved relatively easily. In addition, the insertion of the inner pipe 34 into the outer pipe 32 under the condition of close contact can be accomplished easily through "fit by cooling" or the like method.

Figure 6:
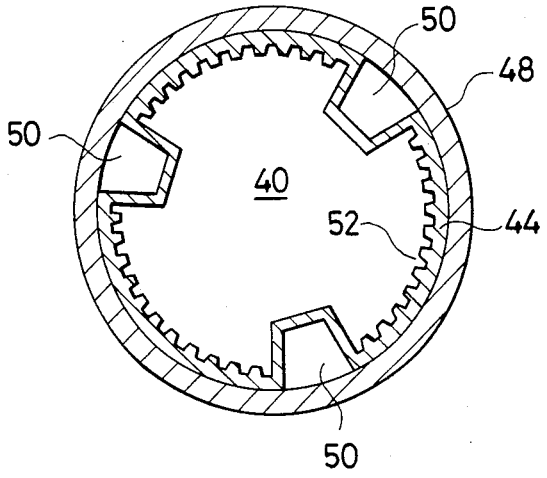
FIG. 6 is a cross-sectional view for a second embodiment of the heat pipe in accordance with the present invention.

Referring to FIG. 6, there is shown a cross-sectional view of a second embodiment of the heat pipe in accordance with the present invention. Here, the components identical to those in the first embodiment will be given identical symbols to simplify the explanation. Namely, the second embodiment is constructed to provide coolant return routes 50 between an outer pipe 48 and an inner pipe 44 by projecting a part of the inner pipe 44 to the inner side or the evaporation passage 46 side. On the inner surface of the inner pipe 44 where no coolant return routes 50 are provided there are created grooves 52, and the grooves 52 and the coolant return routes 50 are connected through by slits that are not shown, in approximately the same manner as in the first embodiment.

In the second embodiment, the cross-sectional area of the coolant return routes 50 can be increased so that the flow resistance of the liquid coolant can be reduced further. Further, the contact area of the outer pie 48 and the inner pipe 44 can be made large so that the heat transfer efficiency in the evaporation section and the condensation section can further be improved.

Figure 7:
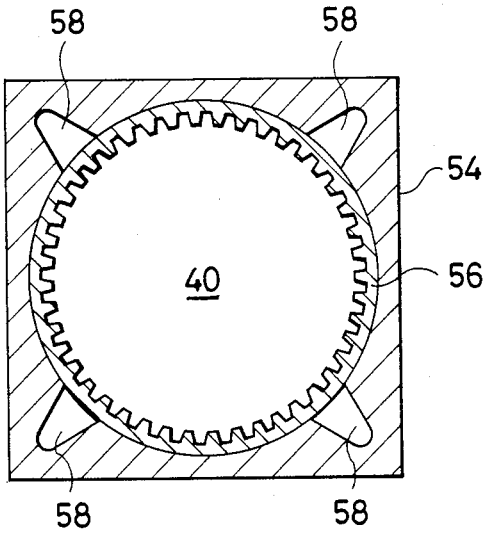
FIG. 7 is a cross-sectional view for a third embodiment of the heat pipe in accordance with the present invention.

Referring to FIG. 7, there is shown a third embodiment of the heat pipe in accordance with the present invention. In the third embodiment, the components identical to those in the first and second embodiments will be given identical symbols to simplify the explanation. In the third embodiment, the external form of the outer pipe 54 is approximately square, and it is given a construction in which the coolant return routes 58 between the outer pipe 54 and the inner pipe 56 are provided by forming cavities at the four corners of the inner surface. The grooves 60 are provided over the entire circumference of the inner surface of the inner pipe 56 similarly to the first embodiment, and the grooves 60 and the coolant return routes 58 are connected through by the slits that are not shown, approximately similarly to the first embodiment. In the third embodiment, approximately analogous to the second embodiment shown in FIG. 6, it is possible to make the cross-sectional area of the coolant return routes 58 large and the contact area between the outer pipe 54 and the inner pipe 56 large also.

It should be noted that the present invention is by no means limited to the foregoing embodiments. Thus, for example, the connective paths that connect through the outer pipe and the inner pipe may be replaced by small holes instead of slits. In short, any structure that connects through the inside and the outside of the inner pipe will do.

Moreover, the above heat pipe will be effective when it is used in the cosmic space because all of the coolant return routes can be utilized. Further, when it is used on the ground, the coolant return routes on the upper side may be done without since the liquid coolant generally flows in the return routes on the lower side.

Figure 8:
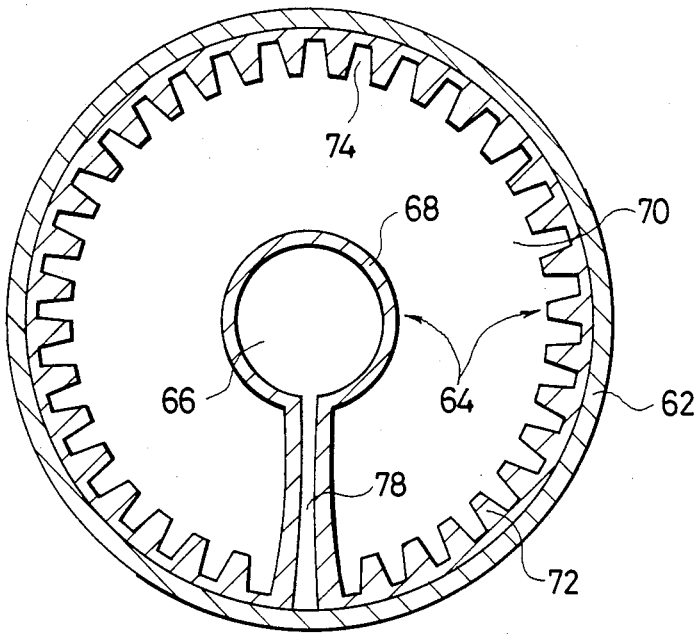
FIG. 8 is a cross-sectional view for a fourth embodiment of the heat pipe in accordance with the present invention.

Referring to FIG. 8, a fourth embodiment of the heat pipe according to the present invention is shown. The fourth embodiment includes a hermetically sealed outer pipe 62 and an inner pipe 64 which is inserted to the outer pipe 62 making close contact with it. The inner pipe 64 has a double-pipe structure which consists of an inside pipe 68 that is formed by projecting a part of the inner pipe 64 to the inner side as a coolant return route 66 and an outside pipe 72 that forms a vapor passage 70 for the coolant. On the inner surface of the outer pipe 72 there are provided, along the axial direction, grooves with relatively small cross-sectional area that extends over the entire circumference, formed between the evaporation section and the condensation section. Furthermore, in the interior of the outside pipe 72 there is formed a vapor passage 70 for the coolant that is evaporated in the evaporation section.

The grooves 74 have a function for causing to generate a pressure difference by means of capillary force to let the liquid coolant flow from the condensation section to the evaporation section, and to carry out heat transfer during the condensation process and the evaporation process. For this purpose, the grooves 74 are made narrow in size to have wider area of contact with the vapor phase.

The coolant return route 66 constituted by the inside pipe 68 is what is called the artery and serve as the main return route to the evaporation section for the liquid coolant that is condensed in the condensation section. Because of this, the cross-sectional area of the coolant return route, namely, the inside pipe 68, is made large compared with that of the groove 74.

Figure 9:
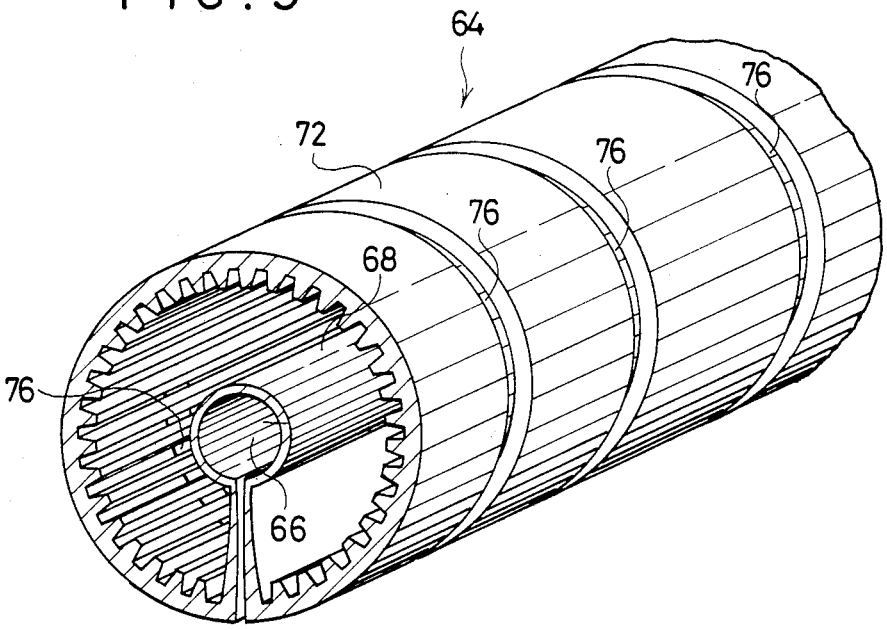
FIG. 9 is a perspective view for the inner pipe of the heat pipe shown in FIG. 8.

Further, there are drilled a plurality of slits 76, as connective paths for connecting through the grooves 74 to the coolant return route 66, in the circumferential direction from the evaporation section side to the condensation section side of the outside pipe 72. The slits 76 are formed, as shown in FIG. 9, extending over the entire circumference on the outer circumferential surface, and are connected through to the grooves 74 on the inner circumferential side.

The inside pipe 68 and the slits 76 on the outside pipe 72 are connected through by a route 78 with a narrow width that is provided extending in the axial direction and having a cross-section which gradually increases in a radially outward direction.

The inside pipe 68, the outside pipe 72, the grooves 74, and the route 78 of the inner pipe 64 can be formed by extrusion, and the slits 76 on the inner pipe 64 may be worked up afterward from outside, so that the manufacture of the inner pipe 64 can be made relatively easily. Further, insertion of the inner pipe 64 into the outer pipe 62 in closely contacting condition can be carried out easily by employing fit by cooling or other method.

Next, the operation of the above embodiment will be described.

After evacuating the interior of the pipe thus constructed, an appropriate coolant is sealed in it. The amount to be sealed will be sufficient if it fills the grooves 74 of the outside pipe 72 and the coolant return route 66.

At the evaporation section of the heat pipe, liquid coolant held in the grooves on the inner surface of the outside pipe 72 evaporates, the liquid surface becomes concave due to decrease in the amount of the liquid coolant, and the pressure of the portion is reduced by the action of surface tension. On the other hand, coolant that is evaporated in the evaporation section reaches through the evaporation passage 70 to the condensation section where it is condensed. Accordingly, the coolant surface of the grooves 74 in the condensation section is nearly flat, and the pressure of the liquid coolant there is higher than that of the liquid coolant in the evaporation section.

Due to the pressure difference in the liquid coolant, the condensed liquid coolant flows into the coolant return route 66 from the grooves in the outside pipe 72 through the slits 76 and the route 78, and is circulated back to the evaporation section. The circulated liquid coolant is supplied to the grooves 74 through the route 78 and the slits 76. In this way, condensed liquid coolant is circulated back mostly through the coolant return route 66 that has smaller flow resistance so that it is possible to obtain a large amount of flow by even a small capillary force in the grooves 74. Therefore, dry-out at the evaporation section is suppressed and a large heat transfer capability can be obtained.

Moreover, since there are areas in which the outer pipe 62 and the inner pipe 64 are brought to a direct contact, it is possible to transfer heat to the evaporation surface and the condensation surface that are on the side of the inner pipe 64. Therefore, there will not be created a large heat resistance in the evaporation section and the condensation section, as it occurs in an artery type heat pipe that utilizes meshes.

Furthermore, the grooves on the outside pipe 72 of the inner pipe 64 may be formed by extrusion and the slits 76 may be worked up from the outer surface, so that the manufacture is made relatively easy. In addition, insertion of the inner pipe 64 into the outer pipe 62 in a close contact condition can be carried out easily by means of fit by cooling or other method.

Still further, since the coolant return route 66 is provided in the interior of the inner pipe 64, heating from the entire circumference of the outer pipe 62 becomes possible.

Figure 10:
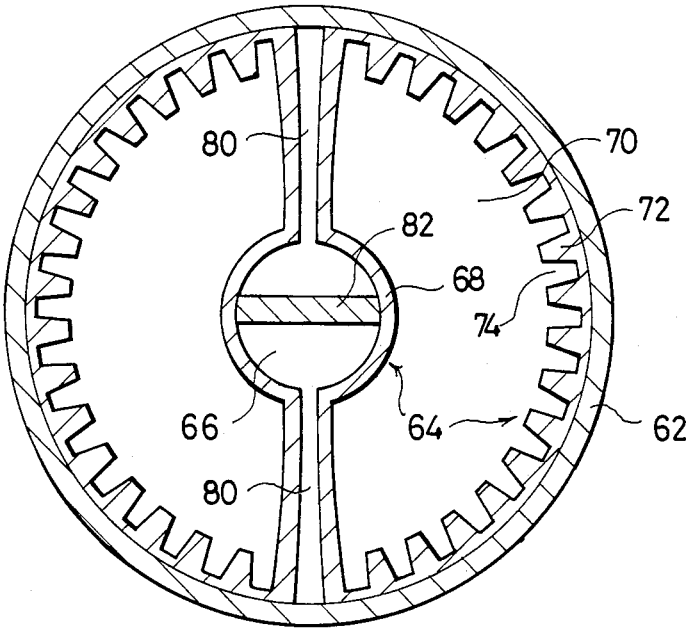
FIG. 10 is a cross-sectional view for a fifth embodiment of the heat pipe in accordance with the present invention.

Referring to FIG. 10, there is shown a cross-sectional view of a fifth embodiment of heat pipe in accordance with the present invention. Here, the components that are identical to those in the fourth embodiment will be given identical symbols to omit explanation. The fifth embodiment has a construction in which there are provided a plurality of routes 80 that connect the outside pipe 72 and the inside pipe 68 which form the coolant return route 66. In this case, there is sometimes provided an inserted plate 82 in the inside pipe 68 in order to press a plurality of fan-shaped pipes against the outer pipe 62.

The embodiment permits to make the routes 80 between the inside pipe 68 and the outside pipe 72 large. Therefore, it is possible to further improve the heat transfer capability through an added reduction in the flow resistance of the liquid coolant.

It should be noted here that the present invention is by no means limited to the above embodiment. Thus, for example, the slits 76 to be drilled on the outside pipe 72 may be formed helically. In essence, it is sufficient to give them a construction that makes it possible to connect through the inside and outside of the outside pipe 72.

In summary, according to the present invention, the inner pipe is given a double-pipe structure which consists of an inside pipe that forms the coolant return route and an outside pipe that forms the vapor passage, with grooves provided on the inner surface of the outside pipe to generate capillary force, connective openings provided on the outer circumferential surface of the outside pipe to connect them to the grooves, and the connective openings on the outside pipe are connected by the connecting routes to the inside pipe. Because of the above, there is no need for providing insertions such as meshes in the tube interior, so that it becomes possible to improve the mechanical strength of the pipe without making heat pipe large in size. Moreover, it becomes possible to bring the inner and the outer pipes to a close contact. This permits a more efficient heat transfer to the evaporation surface or the condensation surface than for the case of using meshes or the like, permitting to obtain a heat pipe with smaller heat resistance. Furthermore, since the coolant return routes are provided inside of the pipe, it is possible to heat the pipe from the entire circumference of the pipe. Finally, manufacture of the heat pipe becomes easier since there is no need for providing grooves in the circumferential direction on the inner surface of the pipe.

What is claimed is:

1. A heat pipe for carrying out heat transfer by circulating a coolant between an evaporation section and a condensation section, comprising:

(a) a hermetically sealed outer pipe;

(b) an inner pipe installed in such a way as to make contact with the inner surface of the outer pipe;

(c) an inner surface of the inner pipe which includes a plurality of small grooves that extend along the axial direction of the inner pipe over the region from the evaporation section to the condensation section;

(d) at least one low resistance return route for allowing the condensed liquid of the coolant to return from the condensation section to the evaporation section;

(e) said at least one return route being arranged within said outer pipe;

(f) means for communicating between the grooves and said at least one return route, said communicating means comprising slits which are formed on and extend around the outer surface of said inner pipe and which intercommunicate with said small grooves formed on said inner surface of said inner pipe;

(g) an inside pie concentrically disposed within the inner pipe; and (h) communicating passage means, having an elongated cross-section, defining a passage disposed within said inner pipe for communicating between the slits and said inside pipe.

2. A heat pipe for carrying out heat transfer by circulating a coolant between an evaporation section and a condensation section, comprising:

(a) a hermetically sealed outer pipe;

(b) an inner pipe installed in such a way as to make contact with the inner surface of said outer pipe;

(c) means for returning condensed liquid coolant under capillary pressure to the evaporation section from the condensation section, said returning means including a plurality of small grooves comprising side walls and a bottom wall extending along the axial direction of the inner pipe over the region from the evaporation section to the condensation section;

(d) an inside pipe installed in the interior of said inner pipe in order to form a low resistance return route for the condensed liquid of coolant for returning from the condensation section to the evaporation section, said inside pipe being located at the center of said inner pipe;

(e) slits cut through an outside surface of said inner pipe over the entire circumference of said inner pipe so as to connect said slits through the bottom walls of the grooves on the inner surface of said inner pipe, in order to provide communication between the grooves on the inner surface of said inner pipe and the low resistance return route; and (f) communicating passage means defining an elongated passage disposed within said inner pipe for communicating between the slits and said inside pipe.

3. A heat pipe for carrying out heat transfer by circulating a coolant between an evaporation section and a condensation section, said heat pipe comprising:

a hermetically sealed outer pipe;

a first inner pipe disposed within the outer pipe and having a plurality of capillary small grooves formed on the inner surface of the first inner pipe and extending along the axial direction of the first inner pipe over the region from the evaporation section to the condensation section;

a second inner pipe formed within the first inner pipe and along the axial direction thereof and allowing the condensed coolant to return from the condensation section to the evaporation section, said second inner pipe being located at the center of said first inner pipe;

slit means disposed in the first inner pipe in the circumferential direction thereof and communicated with the small grooves; and communicating passage means, defining an elongated passage, disposed within the first inner pipe and communicating the second inner pipe with the slit means.

4. A heat pipe as claimed in claim 3, wherein said communicating passage means has a cross section which gradually increases in a radially outward direction.

* * * * *